United States Patent [19]

Grunke

[11] 4,172,771

[45] Oct. 30, 1979

[54] METHOD AND APPARATUS FOR ELECTROLYTICALLY PRODUCING COMPOUND WORKPIECES

[75] Inventor: Richard Grunke, Munich, Fed. Rep. of Germany

[73] Assignee: Motoren- und Turbinen-Union Muenchen GmbH M.A.N. Maybach Mercedes-Benz, Munich, Fed. Rep. of Germany

[21] Appl. No.: 907,993

[22] Filed: May 22, 1978

Related U.S. Application Data

[63] Continuation-in-part of Ser. No. 838,867, Oct. 3, 1977, abandoned.

[30] Foreign Application Priority Data

Oct. 6, 1976 [DE] Fed. Rep. of Germany ..... 2644988

[51] Int. Cl.[2] ..... C25D 15/00; C25D 15/02

[52] U.S. Cl. ..... 204/16

[58] Field of Search ..... 204/16, 129; 427/180, 427/184, 185

[56] References Cited

U.S. PATENT DOCUMENTS

| | | | |
|---|---|---|---|
| 3,061,525 | 10/1962 | Grazen | 204/16 |
| 3,379,634 | 4/1968 | Rutkowski | 204/129 |

FOREIGN PATENT DOCUMENTS

| | | | |
|---|---|---|---|
| 1218179 | 1/1971 | United Kingdom | 204/16 |

*Primary Examiner*—T. M. Tufariello

*Attorney, Agent, or Firm*—W. G. Fasse; D. F. Gould

[57] ABSTRACT

The present method produces compound materials by an electrolytic deposition. The extraneous, non-soluble matter is suspended in a fine distribution in the electrolyte. The foreign or extraneous matter and the metal are deposited in the absence of gravity, whereby homogeneous compound materials may be produced having a uniform and/or defined particle distribution. The present apparatus includes a closed electrolytic bath container. A gas separator is operatively connected to the bath. Supply and receiving containers may be connected to the bath container.

8 Claims, 1 Drawing Figure

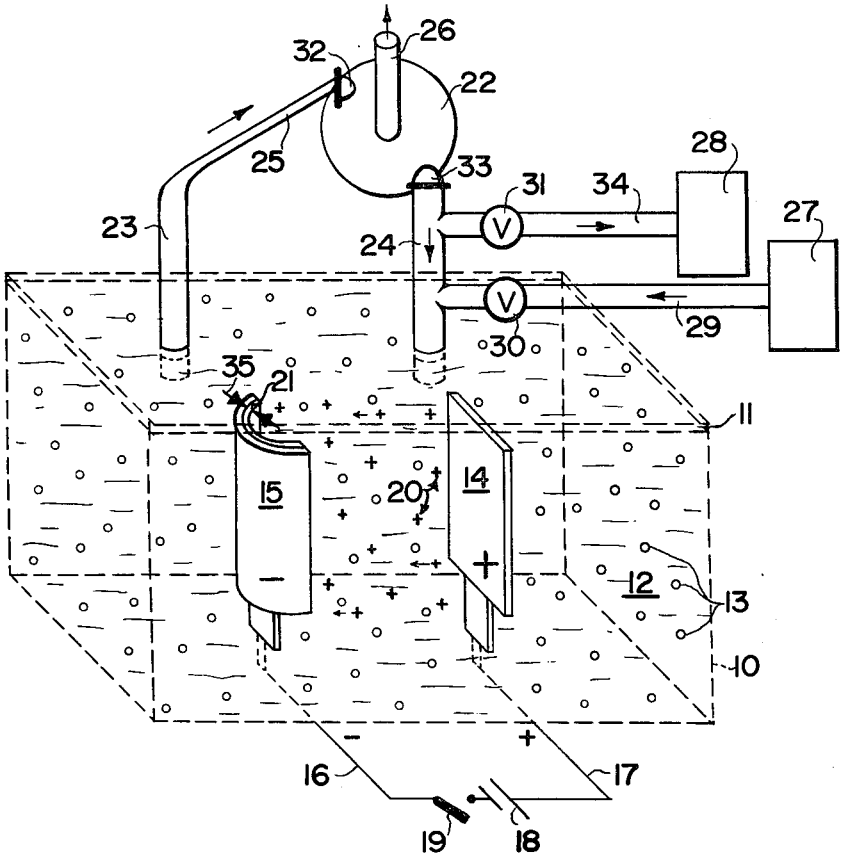
26
32
22
25
33
31
34
28
27
23
24
V
V
29
30
35
21
11
15
20
14
12
13
10
16
17
19
18

METHOD AND APPARATUS FOR ELECTROLYTICALLY PRODUCING COMPOUND WORKPIECES

CROSS REFERENCE TO RELATED APPLICATIONS

This application is a continuation-in-part application of my copending application Ser. No.: 838,867; filed: Oct. 3, 1977, now abandoned.

BACKGROUND OF THE INVENTION

The present invention relates to a method for electrolytically producing compound workpieces such as have coating layers and/or which constitute shaped components. The non-soluable foreign or extraneous material is contained in the electrolyte in a uniform distribution and is deposited together with the metal component. The extraneous material may be particles within a wide range of particle sizes.

Methods of this type are well known in the art for producing layers and shaped parts having a metal matrix in which the solid particles of the extraneous material are embedded in the form of a powder or in the form of fibers. Such deposits are used to provide wear resistant coatings, dry lubrication films, as well as hardenable metal alloys capable of being tempered, for example, to be used as control elements, for instance, in nuclear technology and similar uses.

In performing such electrolytic processes it is essential for the deposition that one obtains a homogeneous compound material in which the particles are uniformly distributed in a defined manner. In order to achieve this, it is necessary that the particles are evenly distributed already in the electrolyte.

Prior art methods for maintaining the particles in suspension in the electrolyte comprise keeping the electrolytic bath in motion, either by air under pressure or by mechanical means. However, this type of keeping the electrolytic bath in motion is not satisfactory for assuring a uniform distribution of the particles in the electrolyte and thus in the matrix to be established. In fact, the distribution is rather non-uniform and it is difficult to control the particle distribution throughout the electrolytic bath.

Another disadvantage in prior art methods for keeping the bath in motion is seen in that the bath motion disturbs the electrolytic processes. Besides, it is not possible to increase the particle density in the bath to the extent desired since it is not possible to keep the particles in suspension where the particle density is high. Thus, the particle distribution becomes even more random. Yet another disadvantage of prior art methods is seen in that the particle size is limited because larger particles tend to sink faster than small particles. Thus, it is necessary to increase the bath motion to the possible limits even where the particles have a size within the range of a mere 3 to 5 microns.

U.S. Pat. No. 3,379,634 discloses an apparatus for performing an electrolysis at zero gravity for the purpose of generating oxygen and hydrogen from an aqueous electrolyte solution. The known apparatus, although suitable for producing gases, for example, in outer space, does not provide any teaching for producing of workpieces by electrolytic deposition.

U.S. Pat. No. 3,061,525 discloses an electrolytic plating method and apparatus which is not suitable for use in outer space because it employs the above mentioned disadvantages of keeping the electrolyte in motion by various mechanical means, whereby it is difficult to sustain a uniform suspension of the particles in the electrolyte liquid. Besides, this known method is limited to smaller particle sizes ranging from sub-micron particles sizes to sizes of up to about 20 mesh.

British Pat. No. 1,218,179 also describes the production of electro-deposited coatings under gravity conditions, whereby the electrolytic bath container has a downwardly tapering bottom which is supposed to facilitate a strong upward flow in the bath. The upward flow is supposed to counteract the gravity. However, no uniform flow distribution and hence no uniform particle distribution throughout the electrolytic bath is possible in accordance with this type of known apparatus. Thus, the just described prior art devices are not suitable for producing high strength composite materials or rather, workpieces of such materials which must meet high performance standards. Such standards can only be met if the materials or workpieces have a maximum homogenity throughout their volume. Such high homogenity is, for example, necessary in turbine vanes of propulsion systems.

OBJECTS OF THE INVENTION

In view of the above, it is the aim of the invention to achieve the following objects, singly or in combination:

- to avoid the difficulties and disadvantages of the prior art, more specifically, to provide a method by means of which homogeneous compound materials and workpieces may be produced having a uniform or defined particle distribution throughout the volume of such materials or workpieces or in certain defined portions of the volume;
- to maintain an electrolytic bath substantially stationary relative to its immediate environment while nevertheless maintaining the particles regardless of their size in suspension in the bath and also in uniform or controlled distribution throughout the electrolytic bath;
- to control the particle distribution and particle density in the bath to any desired degree so that different particle densities may be maintained in different layers of the bath and in the resulting product; and
- to provide an apparatus for performing the present method.

SUMMARY OF THE INVENTION

According to the invention there is provided a method for the electrolytic deposition of compound materials, wherein the electrolytic process takes place at substantially zero gravity from an electrolytic suspension containing the metal and at least one extraneous material such as yttrium oxide, silicon carbide, boron carbide, or titanium carbide and similar materials. Due to the elimination of the influence of gravity, the particles distribute themselves in the electrolytic bath independently of their own characteristic features, for example, independently of their own content and independently of their own size. By avoiding movement of the electrolytic bath, the further advantage is achieved that the electrolytic process takes place under optimal operating conditions.

The apparatus according to the invention for electrolytically producing a component material containing a metal and at least one foreign matter comprises container means for holding an electrolytic bath containing said metal and said foreign matter in the form of particles suspended in the electrolytic bath. A substrate cathode means is positioned in the electrolytic bath opposite an anode. Cover means close the container and a gas liquid separator such as a centrifuge is connected to the electrolytic bath holding container. The separator has a fluid inlet, a gas outlet, and a liquid outlet. A first conduit with a restriction connects the bath container to the fluid inlet of the separator. A second conduit operatively connects the container to the liquid outlet of the separator.

BRIEF FIGURE DESCRIPTION

In order that the invention may be clearly understood, it will now be described, by way of example, with reference to the accompanying drawings, wherein the single FIGURE shows in a somewhat schematic manner, one embodiment of an apparatus according to the invention which may be used in practicing the method according to the invention.

DETAILED DESCRIPTION OF PREFERRED EXAMPLE EMBODIMENTS

An otherwise conventional electrolytic bath has been established in a space station substantially outside the influence of earth gravity. By eliminating the influence of gravity it is now possible to keep the parameters of the electrolytic process much better under control. For example, by varying the current density in the bath by conventional means, it is possible to achieve defined variations of the particle density in the resulting compound material. Means for varying the current density in an electrolytic bath are well known in the art, they are described in any textbook related to the electrolysis.

By the method of the invention it is possible to substantially extend the field of use of electrolytically produced materials. For example, it is now possible to manufacture dispersion hardened combustion chambers and turbine blades as they are used in propulsion system techniques. Protection coatings and absorption coatings may be applied to space vehicles. Wear resistant coatings comprising, for example, 35% of a chromium alloy including $Cr_3C_2$ can now be produced according to the invention.

According to the invention it is now also possible to produce wear resistant layers and/or dry lubricating films having varying particle densities, thus, it is possible, for example, to first apply to a substrate a layer by the electrolytic deposition which does not contain any embedded particles to assure a bonding as strong as possible, whereupon the particle density is gradually increased on top of the intermediate bonding layer. This type of control may be achieved solely by conventional current density controls in the electrolytic baths while simultaneously eliminating or substantially eliminating the influence of gravity.

The just described structure which is produced by first depositing a bonding layer substantially without any embedded particles has the further advantage that the heat removal out of the base material is improved and that relative motions between the material of the substrate and the bonding layer may be diminished in a ductile manner, i.e., by plastic deformation of the interfacial layer.

By employing the methods according to the invention, it is now possible to manufacture shaped components and parts which can be controlled exactly in their material strength characteristics by varying the particle content. This may be accomplished by a programmed particle distribution in the electrolytic bath and a respective particle deposition out of the electrolytic bath.

According to a further feature of the invention it is now possible to further treat the parts or layers produced electrolytically at zero gravity, for example, by subjecting the parts to a sintering process or to a diffusion anealing process all at substantially zero gravity. Similarly, a melt on operation may also be performed while eliminating gravity.

The single FIGURE illustrates an apparatus for performing the electrolytic production method according to the invention for making compound workpieces or materials in outer space. The apparatus comprises a bath container 10, the inner space 12 of which is closed by a cover member 11. To illustrate the content of the container, the outlines are only shown by dashed lines. The container is filled with an electrolyte such as a nickel sulfate water solution wherein yttrium oxide particles are suspended. A nickel anode 14 is operatively supported inside the volume 12 of the container 10. A cathode 15 is also operatively supported. The cathode 15 has a shape or configuration corresponding to the shape of the workpiece to be formed by electrolytic deposition under substantially zero gravity conditions as taught herein. In the shown example the cathode 15 has the shape of a turbine vane 21. The cathode 15 may be made of any suitable metal or even of an insulating synthetic material provided with an electrically conducting additive or coating as is well known in the art.

The cathode 15 is connected to the battery 18 through a conductor 16 and a switch 19. The anode 14 is connected to the battery 18 through a conductor 17.

When the switch 19 is closed an electric circuit is established through the electrolyte in the volume 12 and through the electrodes 14 and 15, whereby the positive nickel ions 20 travel from the anode 14 to the cathode 15.

The ion flow of nickel ions 20 entrains the yttrium particles 13 which are uniformly distributed in the volume 12, as the nickel ions 20 travel to the cathode 15 where the nickel ions and the yttrium particles are deposited, thereby forming a nickel yttrium oxide layer constituting the workpiece 21 on the surface of the cathode 15. The workpiece 21 may be directly used upon completion or it may be subjected to a shape correcting machining or the like such as a heat treatment.

The current density in the electrolytic bath in the volume 12 is selected in accordance with well known values as they are used in galvano-techniques, for example, a current density of two amperes per decimeter square (2 Amp/dm$^2$). Such a current density has been used for the following electrolytic bath:

$NiSO_4.6H_2O$—23 g/l $NaH_2PO.H_2O$—20 g/l

The operating conditions of this bath were as follows:

PH value of the bath—4.6 temperature of the bath—94° C.;

particle concentration—5 to 15 g/l;

depositing speed—16 to 18 microns/hour.

Numerous tests under substantially zero gravity conditions have shown that in a bath as described above, only a slight bubble formation takes place at the cathodes 15. Surprisingly, this bubble formation does not hinder in any way whatsoever the current flow and the electrolytic process. Moreover, it has been found in the actual tests that the individual bubbles stay small and do not merge with other bubbles so that newly formed bubbles displace previously formed bubbles from the electrode surface without thereby merging with the previously formed bubbles. This is a surprising result which prevents the growing of the bubbles. Thus, the deposition of the particles and of the ions is not adversely affected in any substantial manner. However, the invention also provides for the removal of any gas formed in the electrolytic process. This may be accomplished according to the invention, especially where the depositing process extends over longer periods of time, by means of a gas liquid separator 22 such as a centrifuge having a fluid inlet port 32, a gas outlet port 26 and a liquid outlet port 33. The gas liquid separator 22, such as a centrifuge is connected with its inlet port 32 to a supply conduit 23 which reaches into the electrolytic bath in the container 10. The supply conduit 23 comprises a section 25 of restricted diameter for accelerating the liquid gas flow into the centrifuge 22, whereby a sufficient centrifugal force is provided in the centrifuge for centrifuging the liquid and particles against the centrifuge wall while the gas is collected centrally in the centrifuge for removal through the exit port or pipe 26.

The conduit 24 connects the outlet port 33 of the centrifuge 22 back into the volume 12 and thus into the electrolytic bath, whereby the degassed liquid is returned into the container 10. This type of structure does not generate an excessive liquid movement in the bath, in fact, only a very small liquid movement is caused which is satisfactory for the present purposes.

The just described flow system, especially the return conduit 24 may be used, according to the invention for replenishing the particles 13 in the bath. For this purpose a particle storage container 27 is operatively connected to the return conduit 24 through a pipe 29 and a valve 30. When the valve 30 is open particles are withdrawn from the storage 27 by the suction flow through the conduit 24. Preferably, the storage 27 contains an electrolytic solution with an enriched particle concentration. Simultaneously it is possible to also open the valve 31 which connects the storage container 28 through a pipe 34 to the return conduit 24 upstream of the connection point between the conduit 24 and the pipe 29. Thus, electrolytic solution from which the particle concentration has been depleted is returned into the storage 28.

As described above, the present method has been performed in outer space under substantially zero gravity conditions. Under such conditions the particles 13 remain uniformly distributed in suspension independently of their size and density. If the system would be used under the influence of gravity, the particles would sink and it would not be possible to maintain their uniform distribution and suspension. Even if a turbulent flow would be created through the conduit system 23, 22, 24, such flow would not be capable of maintaining the particles in suspension. Exepcially larger particles would sink in spite of the flow. Besides, the electrolytic process would be detrimentally affected by a very strong liquid motion.

After the composite workpiece 21 has the desired thickness 35, the cathode 15 with the workpiece 21 deposited thereon, is removed from the container 10, and, if desired, the workpiece may be subjected to further working or machining, either directly in outer space or on earth. The substrate cathode 15 may, depending on the type of material of which it is made, be removed mechanically, for example, by machining on a lathe, or by grinding or it may be removed mechanically by means of solvents so that only the composite workpiece 21 remains which has a homogeneous structure. The workpiece 21 may be further subjected to shaping or forming by conventional means or it may be subjected to a heat treatment for achieving a desired molecular structure.

Although the invention has been described with reference to specific example embodiments, it is to be understood that it is intended to cover all modifications and equivalents within the scope of the appended claims.

What is claimed is:

1. A method for electrolytically producing a compound material containing a metal and at least one foreign matter comprising the following steps, preparing an electrolytic bath to contain said metal and said foreign matter, the latter in the form of particles suspended in said electrolytic bath, maintaining said bath substantially outside the field of gravity while simultaneously substantially avoiding movement of the electrolytic bath, using a cathode as a substrate in said electrolytic bath, and performing an electrolytic deposition on said substrate cathode substantially at zero gravity.

2. The method of claim 1, wherein said foreign matter is nonsoluable in the electrolyte and comprises particles in substantially uniform distribution in the electrolyte.

3. The method of claim 1, wherein the electrolytic process is performed on board a space station.

4. The method of claim 1, further comprising removing the compound material from the electrolytic bath and performing a sintering substantially at zero gravity.

5. The method of claim 1, further comprising removing the compound material from the electrolytic bath and subjecting the compound material to diffusion anealing at substantially zero gravity.

6. The method of claim 1, further comprising shaping said substrate cathode to conform to the desired shape of the compound material being deposited.

7. The method of claim 1, further comprising removing the substrate cathode from said composite material after the latter has been electrolytically deposited on said substrate cathode.

8. The method of claim 1, further comprising circulating said electrolytic bath through a gas separator means.

* * * * *